US010518166B1

(12) United States Patent
Chen et al.

(10) Patent No.: US 10,518,166 B1
(45) Date of Patent: Dec. 31, 2019

(54) BOARD GAME—MATCH

(71) Applicants: Willa Angel Chen, San Jose, CA (US); Shikui Kevin Chen, San Jose, CA (US); Quanjun Ling Chen, San Jose, CA (US)

(72) Inventors: Willa Angel Chen, San Jose, CA (US); Shikui Kevin Chen, San Jose, CA (US); Quanjun Ling Chen, San Jose, CA (US)

( * ) Notice: Subject to any disclaimer, the term of this patent is extended or adjusted under 35 U.S.C. 154(b) by 0 days.

(21) Appl. No.: 16/118,105

(22) Filed: Aug. 30, 2018

(51) Int. Cl.

| | |
|---|---|
| ***A63F 9/18*** | (2006.01) |
| ***A63F 1/04*** | (2006.01) |
| *A63F 11/00* | (2006.01) |
| *A63F 1/00* | (2006.01) |

(52) U.S. Cl.
CPC ..... *A63F 1/04* (2013.01); *A63F 1/00* (2013.01); *A63F 9/18* (2013.01); *A63F 11/0074* (2013.01); *A63F 2001/0408* (2013.01); *A63F 2001/0416* (2013.01); *A63F 2001/0441* (2013.01); *A63F 2009/186* (2013.01); *A63F 2011/0086* (2013.01); *A63F 2300/8064* (2013.01)

(58) Field of Classification Search
CPC ..... A63F 2009/186; A63F 9/18; A63F 2009/188; A63F 2001/0441; A63F 2001/0416; A63F 1/00; A63F 11/0074; A63F 2011/0086; A63F 2300/8064
USPC ..... 273/429–432, 292
See application file for complete search history.

(56) References Cited

U.S. PATENT DOCUMENTS

| | | | | | |
|---|---|---|---|---|---|
| 4,872,681 | A * | 10/1989 | Martin | A63F 3/00 | 273/118 R |
| 5,112,064 | A * | 5/1992 | Weedman | A63F 3/0478 | 273/429 |
| 5,480,157 | A * | 1/1996 | Plummer | A63F 3/00006 | 273/432 |
| 5,882,008 | A * | 3/1999 | Siegesmund | A63F 3/00006 | 273/249 |
| 6,139,016 | A * | 10/2000 | Plato | A63F 3/00 | 273/242 |
| 7,694,974 | B1 * | 4/2010 | Fowler-Gehring | A63F 1/04 | 273/429 |

(Continued)

*Primary Examiner* — Benjamin Layno

(57) ABSTRACT

In this board game, players take turns being the Chief and rating their level of agreement with prompts such as: "For $1000, I would be willing to wear the same underwear for a week without washing it." The opinions are guessed using a scale from 1 ("Frostbite!—Completely Disagree") to 10 ("All Ablaze!—Completely Agree"). Before the Chief reveals his/her rating, all of the other players guess the Chief's response using secret voting tokens, and all the votes are revealed simultaneously. At the end of the round, the closest matches score victory points. With over 700 cards already written, the prompts cover an enormous range of topics from intimate to hilarious, from every-day to fantastical, from family-oriented to party-friendly. Since the point system requires collecting points of all colors in order to win, you cannot win simply by knowing one other player extremely well. In fact, based on your point balance, you may discover which of your friends you ought to get to know better! This game promises to bring family and friends closer together by sparking meaningful, fun, and intellectual conversations that will continue even after the game itself is over.

11 Claims, 5 Drawing Sheets

(56) References Cited

U.S. PATENT DOCUMENTS

| | | | | |
|---|---|---|---|---|
| 8,006,979 | B1 * | 8/2011 | Lamm | A63F 3/00119 273/276 |
| 2004/0183252 | A1 * | 9/2004 | Robinson | A63F 3/00006 273/243 |

* cited by examiner

| Category | Sample Prompt Statements |
|---|---|
| LIVING SITUATION | At some point in my life, I will move permanently to a different country. |
| | It would be fun to live in a treehouse for a week. |
| | I would love to move to a large ranch in the countryside. |
| | In a house, a large living room is more important to me than a large yard. |
| EVERYDAY HOBBIES | I enjoy solving crossword puzzles. |
| | I would be excited to take a woodworking class. |
| SKILLS | You can't teach an old dog new tricks. |
| | I would rather improve my conversational skills than my public speaking skills. |
| | I am good at drawing a perfect circle. |
| TOMORROW'S ADVENTURES | I would be too frightened of skydiving to enjoy it. |
| | Climbing Mt. Everest would be a worthwhile experience for me. |
| | Sleeping in a cave overnight sounds like fun. |
| SCHOOL | Elementary school was one of the best parts of my life. |
| | I skip(ped) class frequently. |
| | I would prefer the social scene of a large university over that of a small one. |
| CAREER | I would love to be the President of the United States. |
| | I would enjoy being a farmer. |
| | My current job is similar to my dream job. |
| TRAVEL | I am likely to travel to a different country over the next 6 months. |
| | I would like to travel to North Korea. |
| | Before traveling, I wait until the last minute to pack my suitcase. |
| BOOKS | Over the next month, I will start and finish reading a book. |
| | I enjoy reading romance novels. |
| | Once I start reading a book, I feel compelled to finish it regardless of whether I like it. |
| MOVIES | I enjoy watching scary movies. |
| | If I could be a supervillain, I would. |
| | I easily cry when watching sad movies. |

FIGURE 4

Scaling Guide

| | | |
|---|---|---|
| 1 | **Frostbite!** | The Chief completely disagrees with this statement! |
| 2 | **Icy** | The Chief strongly disagrees with this statement. |
| 3 | **Cold** | The Chief disagrees with this statement. |
| 4 | **Chilly** | The Chief somewhat disagrees with this statement. |
| 5 | **Breezy** | The Chief slightly disagrees with this statement. |
| 6 | **Lukewarm** | The Chief slightly agrees with this statement. |
| 7 | **Warm** | The Chief somewhat agrees with this statement. |
| 8 | **Hot** | The Chief agrees with this statement. |
| 9 | **On fire** | The Chief strongly agrees with this statement. |
| 10 | **All ablaze!** | The Chief absolutely, wholeheartedly agrees with this statement! |

FIGURE 6

| Scenario | Points for Chief | Points for Best Match(es) |
|---|---|---|
| Everyone EXCEPT the Chief chose the same answer. It's a crazy match! | 0 | 3 |
| One or more players guessed exactly the right answer. It's a match! | 2 | 2 |
| Nobody guessed exactly right, but some guesses were closer. | 0 | 1 |

FIGURE 7

BOARD GAME—MATCH

FIELD OF THE INVENTION

The present invention relates generally to multi-player interactive board games, includes both those played face-to-face using a physical apparatus and those played online using an electronic or mobile device. More particularly, it pertains to a new board game wherein a player attempts to earn victory points from each of the other players by comparing numerical rankings indicating level of agreement with a statement on prompt cards.

BACKGROUND

There are many types of games wherein the players attempt to match answers or results to prompt questions. Frequently, such games involve either writing down answers in words or phrases, or matching graphic characteristics. There are other games wherein the answers, though in numeric form, are compared to the actual numerical solutions to the questions on the prompt cards. Such board games are indicated and exemplified in the U.S. Pat. Nos. 6,328,308, 3,734,510, 5,054,775, 7,654,533, and 8,496,517, and Patent Application Publication No. US 2010/0301563A1, each of which is incorporated herein by reference in its entirety for all purposes.

The present invention attempts to overcome deficiencies of the prior art by limiting the answers to the range 1 to 10 representing levels of agreement (and do not represent real-life quantities). Because of this, players can guess using voting chips, rather than writing their answers on paper. The numeric answer is the "Chief's" rating of his/her own opinion and, therefore, no mathematical skills or direct knowledge of the subject of the questions on the prompt cards are necessary.

Although some board games in prior art and our patent application here may all involve presenting players with questions that can be answered numerically, those board games in the prior art typically deal with "trivia questions" that have factually correct answers (generally written on opposite side of the question card). However, our application, on the other hand, specifically involves opinion-based questions for which the answer necessarily depends on the identity of the current question-asker ("Chief" in the claims). One notable consequence of this is that our game can be replayed numerous times with the same set of question cards.

The present invention also includes a unique scoring system in which there are different "colors" or "shapes" of victory points, awarded by different players. In fact, to win the game, one has to collect victory points of all different colors or shapes, providing motivation to get to know all other players, instead of just knowing one other player extremely well. Those games described in the prior art usually don't distinguish sources of victory points.

In addition, the present invention provides an objective opportunity to earn victory points. Unlike other conversation-starter games such as Say Anything and Apples to Apples, there is no pressure for the active player to choose an arbitrary favorite answer, and king-making is impossible; the active player does not have the power to favor a certain player.

SUMMARY

In this board game, players take turns being the Chief and rating their level of agreement with prompts such as: "For $1000, I would be willing to wear the same underwear for a week without washing it." The opinions are guessed using a scale from 1 ("Frostbite!—Completely Disagree") to 10 ("All Ablaze!—Completely Agree"). Before the Chief reveals his/her rating, all of the other players guess the Chief's response using secret voting tokens, and all the votes are revealed simultaneously. At the end of the round, the closest matches score victory points. With over 700 cards already written, the prompts cover an enormous range of topics from intimate to hilarious, from every-day to fantastical, from family-oriented to party-friendly. Since the point system requires collecting points of all colors in order to win, you cannot win simply by knowing one other player extremely well. In fact, based on your point balance, you may discover which of your friends you ought to get to know better! This game promises to bring family and friends closer together by sparking meaningful, fun, and intellectual conversations that will continue even after the game itself is over.

BRIEF DESCRIPTION OF THE DRAWINGS

The invention and the advantages thereof, may best be understood by reference to the following description taken in conjunction with the accompanying drawings in which:

FIG. 4 is a sample of example statements on prompt cards.

FIG. 6 is the recommended scaling guidelines.

FIG. 7 is the recommended scoring guidelines.

DETAILED DESCRIPTION

Figure 1:
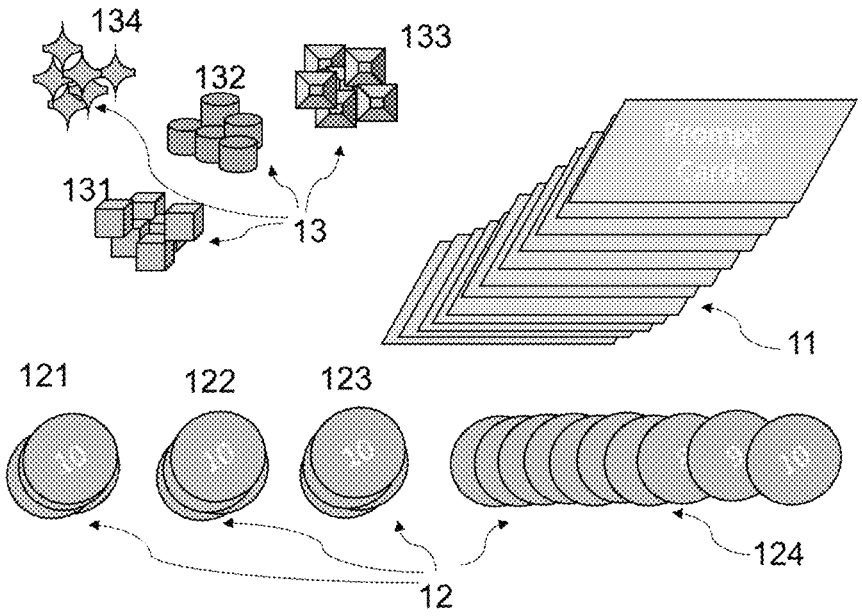
FIG. 1 is a sketch illustrating pieces in this board game.

Referring to FIG. 1, this game is play using a plurality of prompt cards 11, a plurality of voting chips 12, and a plurality of victory point tokens 13. It is preferable that the prompt cards be made of a suitable rigid paper-like or cardboard material or the like. Preferably, the voting chips 12 are provided in sets of different colors, each set having ten voting chips, such as yellow set 121, red set 122, blue set 123, and green set 124. It is also preferable that the victory point tokens 13 are provided in sets of different colors and/or different shapes, each set having a plurality of tokens matching the colors of the voting chips, such as yellow cubes 131, red cylinders 132, blue trapezoids 133, and green flats 134. It is to be understood that additional sets of different colored voting chips and different colored or shaped victory point tokens could be provided for play of the game by more than four players. It is further understood that the shapes drawn in FIG. 1 are for illustration purpose only and it should not be construed that the designs are limited to those depicted.

Figure 2:
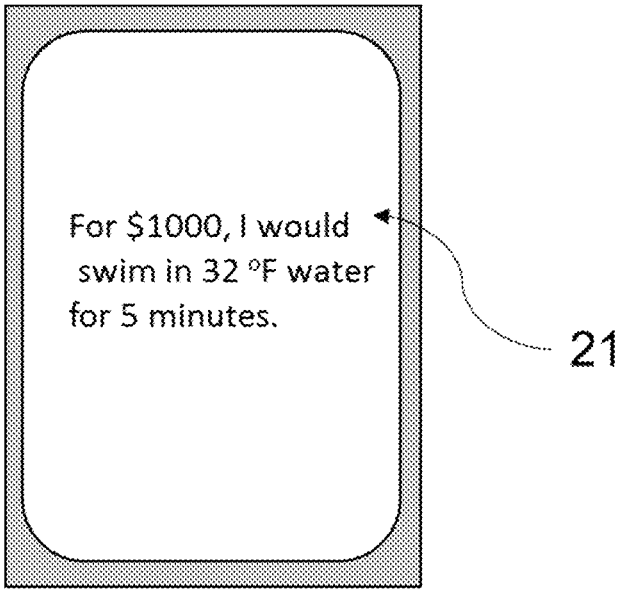
FIG. 2 is example of first side of a prompt card.
Figure 3:
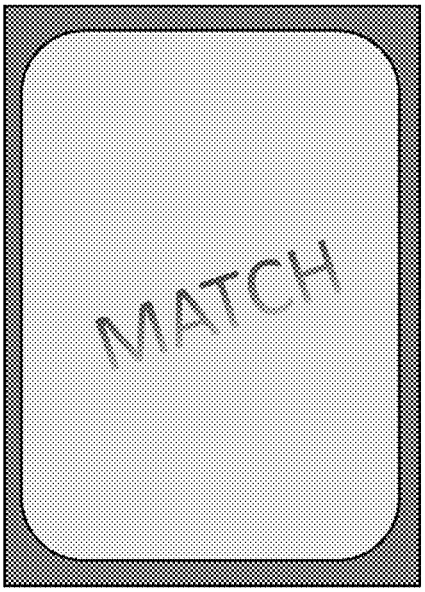
FIG. 3 is example of second side of a prompt card.

FIG. 2 and FIG. 3 illustrate first side and second side of prompt card 11, respectively. The first side of each prompt card 11 preferably contains an opinion or a statement 21 from a perspective of the player who draw the card. A sample of example statements are shown in FIG. 4.

To begin the game, each player chooses a color and receives a set of voting chips and a set of victory point tokens of that color. Now, referring to FIG. 5, the first step of the game (Step 50) is to choose a player to be the first Chief. A plurality of methods can be used to determine who should be the first Chief. As an example, the first Chief can be the player whose birthday is closest to the day when this game is played.

After the first Chief is decided, at Step 51, the Chief draws a card from a deck of prompt cards, which should have been thoroughly shuffled to randomize the statements. At this time, the Chief reads the statement out loud for all player to hear and places the card on the table.

Figure 5:
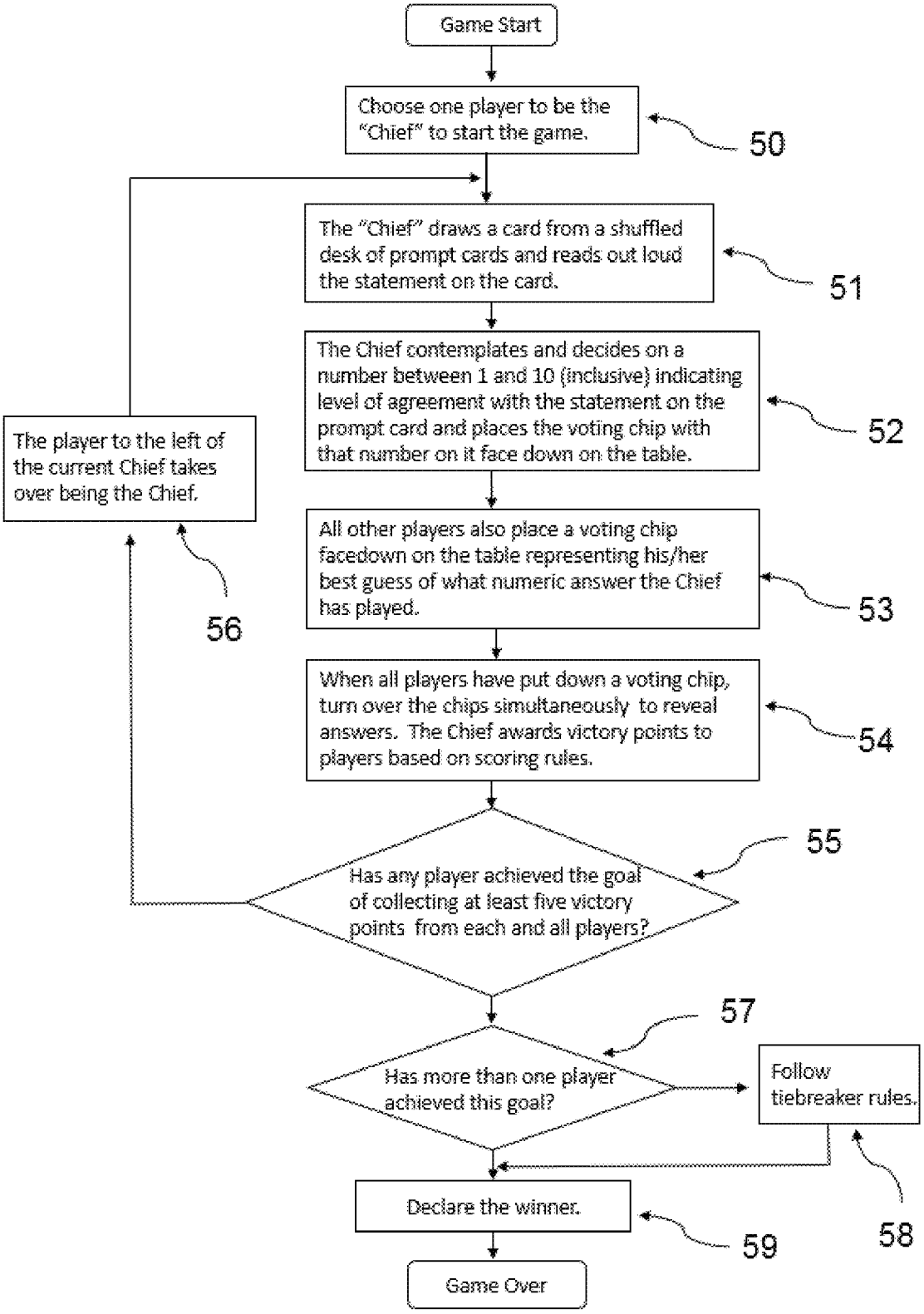
FIG. 5 is a flowchart illustrating an embodiment of the game.

At Step 52, the Chief contemplates how strongly he or she agrees with the statement on the prompt card, on a scale from 1 to 10, with 1 representing "completely disagrees with the statement (Frostbite!)" and 10 representing "absolutely, wholeheartedly agrees with the statement (All Ablaze!)." A scaling guide is shown below and in FIG. 5. Then the Chief secretly chooses a voting chip corresponding to the rating he or she decided on and places the chip face-down on the table in front of him/her.

Scaling Guide

| | | |
|---|---|---|
| 1 | Frostbite! | The Chief completely disagrees with this statement! |
| 2 | Icy | The Chief strongly disagrees with this statement. |
| 3 | Cold | The Chief disagrees with this statement. |
| 4 | Chilly | The Chief somewhat disagrees with this statement. |
| 5 | Breezy | The Chief slightly disagrees with this statement. |
| 6 | Lukewarm | The Chief slightly agrees with this statement. |
| 7 | Warm | The Chief somewhat agrees with this statement. |
| 8 | Hot | The Chief agrees with this statement. |
| 9 | On fire | The Chief strongly agrees with this statement. |
| 10 | All ablaze! | The Chief absolutely, wholeheartedly agrees with this statement! |

Moving on Step 53, each of all other players tries to guess what the Chief might have chosen and places a voting chip face-down with their guesses.

When all players have put down their chips, at Step 54, flip over the voting chips simultaneously to reveal the answers. The Chief then compares the answers and awards victory point tokens to some or all players based on scoring guidelines. The color of the victory point tokens being awarded is the color of the player who is the Chief. For example, when the purple player is the Chief, all players have an opportunity to score purple points.

A set of guidelines for preferred embodiment is illustrated in FIG. 7. If everyone EXCEPT the Chief chose the same answer, the everyone except the Chief scores 3 points each. Otherwise, if any player(s) guessed exactly the right answer, i.e. chose the same answer as that of the Chief, each player that guessed exactly the right answer scores 2 points. The Chief scores 2 points as well. Otherwise, whichever player guessed the closest answer gets 1 point. In case of ties, all of the players with the closest answers score 1 point each. The Chief scores no points.

After the victory points are awarded, at Step 55, check to see whether any player(s) has achieved the goal of collecting at least 5 victory points from each and all players. If not, then go on the Step 56 to continue the game. If yes, then move on to Step 57 to determine the winner of the game.

If no player has collected at least 5 victory points of each color, at Step 56, the role of Chief is passed around the table in order clockwise. That is, the player to the left of the current Chief takes over being the Chief. The new Chief draws a card from the deck of prompt cards and the game continues from Step 51.

If one or more players have achieved the goal of collecting at least 5 victory points of each color, then at Step 57, determine whether a tiebreaker is needed.

If more than one player has achieved the goal simultaneously, at Step 58, as a tiebreaker, the player who has earned the highest total number of victory points is to be considered the winner of the game. If two or more players who have earned the same highest number of victory points, then they are to be considered co-winners.

If only one player has achieved the goal, then he or she should be declared as the winner of the game. Congratulate him or her for being the person who best understands all of you. This game is not over yet; it is just getting started. Now you have discovered which of your friends you ought to get to know better. It's time to spark a conversation.

The foregoing detailed description has been given for clarity of understanding only, and no limitations should be understood therefrom, as some modifications may be obvious to those skilled in the art.

What is claimed is:

1. A method for playing a game, the method comprising of:

providing a plurality of prompt cards, a plurality of sets of voting chips, and a plurality of sets of victory point tokens, wherein one side of each of the prompt cards consisting of only an opinion or only a statement having no suggested answers printed thereon, and the opposite side of each of the prompt cards consisting of either a blank or a common indicia among all the prompt cards, wherein the blank or the common indicia having no association in playing the game;

providing each player participating in the game with a set of voting chips and a set of victory point tokens; wherein each set consisting of a plurality of voting chips and victory point tokens having a common and matching color, wherein each player is assigned a commonly colored set of voting chips and victory points tokens, and that each set of voting chips and victory tokens having a color different from the other sets of voting chips and victory tokens, wherein each different player is assigned a differently colored set of voting chips and victory points tokens, and wherein each voting chip having a number indicating an opinion on a numeric scale from 1 to 10;

alternating between each of the players drawing a prompt card from a plurality of prompt cards, wherein each prompt card having a unique statement different from the other prompt cards; wherein the player drawing the prompt card plays one of their assigned numeric voting chips based on his/her opinion of agreeing with or disagreeing with the statement on the drawn prompt card, with "1" being that the player drawing the card completely disagrees with the statement and "10" being that he or she absolutely and wholeheartedly agrees with the statement, the numeric answer on the played voting chip being hidden from the other players, and all other players play one of their assigned numeric voting chips, also hidden from view of the other players, attempting to match the numeric answer on the voting chip played by the player drawing the prompt card;

revealing the numeric answer on each of the hidden voting chips after all players have played the voting chips wherein the player drawing the prompt card awards other players victory point tokens of his/her own color and wherein the number of victory point tokens awarded depends on how closely the numeric answer of each player's voting chip matching the numeric answer of the player drawing the prompt card;

winning the game by a player who is the first one to be awarded a threshold number of victory point tokens of each of all participating players' colors in the game.

2. The method as recited in claim 1 wherein the player drawing prompt card is named "Chief" and the role of being the Chief is passed around the table in either clockwise or counter-clockwise order.

3. The method as recited in claim 1 wherein the Chief indicates level of agreement with the statement on the prompt card using a scale from 1 to 10 where 1 being that the Chief completely disagrees with the statement and 10 being that the Chief absolutely and wholeheartedly agrees with the statement.

4. The method as recited in claim 1 wherein other players offer their guess of Chief's rating by placing one of their own voting chips using the numeric scale.

5. The method as recited in claim 1 wherein players are awarded with different number of victory points by comparing other players' numeric answers with that of the Chief; and wherein a. Scenario 1: Nobody guessed exactly right compared to the answer of the Chief, no point is awarded to the Chief and the player with closest answer is awarded one or more victory points;

b. Scenario 2: One or more players guessed exactly the right answer, both the Chief and the player(s) with the correct answer are awarded victory points valued twice as much as in Scenario 1;

c. Scenario 3: Everyone EXCEPT the Chief chose the same answer, everyone except the Chief are awarded victory points amounted to three times as much as in Scenario 1.

6. A board or table game comprising:

a plurality of prompt cards, a plurality of sets of voting chips, and a plurality of sets of victory point tokens;

wherein each set of voting chips and victory point tokens having a common and matching color, and that each set of voting chips and victory tokens having a color different from the other sets of voting chips and victory tokens;

wherein each prompt card consisting of only an opinion or only a statement and having no suggested answers are printed thereon, the opposite side of each of the prompt cards consisting of either a blank or a common indicia among all the prompt cards, wherein the blank or the common indicia having no association in playing the game;

Wherein each player participating in the game is assigned a commonly colored set of voting chips and victory point tokens, and wherein each different player is assigned a differently colored set of voting chips and victory point tokens:

wherein each of the players participating in the game takes turns drawing a prompt card and wherein the player drawing the prompt card is named "Chief" and the "Chief" plays one of his/her assigned numeric voting chips based on his/her agreement or disagreement with the statement on the drawn prompt card, all other players play one of their assigned voting chips in an attempt to match the voting chip played by the "Chief"; and wherein each voting chip indicates an opinion on a numeric scale from 1 to 10 with "1" being that the player drawing the card completely disagrees with the statement and "10" being that absolutely and wholeheartedly agrees with the statement; and wherein the colors of the victory point tokens are different for different players and wherein players are awarded with different number of victory point tokens by comparing other players' voting answers with that of the Chief; and wherein a player wins the game by being the first one to be awarded a threshold number of victory point tokens of each color of all participating players' colored victory point tokens in the game.

7. The game as recited in claim 6 wherein the prompt cards are made of a suitable rigid paper-like or cardboard material and wherein one side of each prompt card is printed with an opinion or a statement while the opposite side of all cards have either blank or common indicia.

8. The game as recited in claim 6 wherein the voting chips are provided in sets of different colors, each set having ten voting chips, each chip having one numeric value from 1 to 10.

9. The game as recited in claim 6 wherein the victory point tokens are provided in sets of different colors and/or different shapes, each set having a plurality of tokens matching the colors of the voting chips.

10. The game as recited in claim 6 wherein voting chips represent ratings indicating level of agreement with the statement on the prompt card.

11. The game as recited in claim 6 wherein the victory point tokens are awarded to players by comparing other players' answer to that of the Chief.

* * * * *